US010205233B2

(12) United States Patent
Moon et al.

(10) Patent No.: US 10,205,233 B2
(45) Date of Patent: Feb. 12, 2019

(54) DUAL POLARIZATION ANTENNA INCLUDING ISOLATION PROVIDING DEVICE

(71) Applicant: KMW Inc., Hwaseong, Gyeonggi-Do (KR)

(72) Inventors: Young-Chan Moon, Gyeonggi-Do (KR); Sunghwan So, Gyeonggi-Do (KR); Yong-Won Seo, Gyeonggi-Do (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 82 days.

(21) Appl. No.: 14/622,272

(22) Filed: Feb. 13, 2015

(65) Prior Publication Data

US 2015/0155622 A1 Jun. 4, 2015

Related U.S. Application Data

(63) Continuation of application No. PCT/KR2013/007331, filed on Aug. 14, 2013.

(30) Foreign Application Priority Data

Aug. 14, 2012 (KR) ..... 10-2012-0088850

(51) Int. Cl.
*H01Q 1/52* (2006.01)
*H01Q 21/06* (2006.01)
(Continued)

(52) U.S. Cl.
CPC ..... *H01Q 1/525* (2013.01); *H01Q 21/0075* (2013.01); *H01Q 21/06* (2013.01); *H01Q 21/24* (2013.01)

(58) Field of Classification Search
CPC ..... H01Q 5/335; H01Q 5/50
(Continued)

(56) References Cited

U.S. PATENT DOCUMENTS 5,027,123 A 6/1991 Haykin et al.
6,141,539 A * 10/2000 Marino ..... H01Q 1/525 343/700 MS
(Continued)

FOREIGN PATENT DOCUMENTS

CN 1567652 A 1/2005
CN 102237906 A 11/2011
KR 10-2006-0108343 A 10/2006

OTHER PUBLICATIONS

Examination Report dated Dec. 30, 2016 in corresponding Chinese Application No. 201380043081.7.

*Primary Examiner* — Hoang Nguyen
*Assistant Examiner* — Jae Kim
(74) *Attorney, Agent, or Firm* — Mintz Levin Cohn Ferris Glovsky and Popeo, P.C.; Kongsik Kim; Jhongwoo Jay Peck

(57) ABSTRACT

The present invention relates to a dual-polarization antenna including an isolation providing device including: a transmission antenna element outputting a transmission signal provided via a feeder through a first port; a receiving antenna element receiving a reception signal so as to provide same to the second port; a first coupler distributing part of the transmission signal; an equalizer equalizing the distributed signal from the first coupler to a preset waveform; a second coupler receiving the output of the equalizer so as to couple same to a signal output to the second port; and a conductor forming a signal delivery path between the first coupler, the equalizer, and the second coupler. The coupling performance of the first and second couplers, the length of the conductor, and the functional characteristics of the equalizer are
(Continued)

designed to allow a signal coupled to the second port through the signal delivery path using the conductor to have substantially identical amplitudes and a 180 phase difference, and an identical shape in an overall operating frequency band in contrast to a signal falsely inputted to a receiving antenna from the transmitting antenna element.

6 Claims, 4 Drawing Sheets

(51) Int. Cl.
*H01Q 21/00* (2006.01)
*H01Q 21/24* (2006.01)

(58) Field of Classification Search
USPC ..... 343/703, 722, 745, 749, 850, 853
See application file for complete search history.

(56) References Cited

U.S. PATENT DOCUMENTS

| | | | |
|---|---|---|---|
| 6,310,585 | B1 | 10/2001 | Marino |
| 2006/0097940 | A1 | 5/2006 | Shimawaki et al. |
| 2011/0256857 | A1 | 10/2011 | Chen et al. |

* cited by examiner

DUAL POLARIZATION ANTENNA INCLUDING ISOLATION PROVIDING DEVICE

CROSS-REFERENCE TO RELATED APPLICATIONS

This application is a continuation of International Application No. PCT/KR2013/007331 filed on Aug. 14, 2013, which claims a priority to Korean Patent Application No. 10-2012-0088850 filed on Aug. 14, 2012. The applications are incorporated herein by reference.

TECHNICAL FIELD

The present invention relates to a transceiving antenna used for a base station, a relay, or the like of a mobile communication system, and more particularly, to a dual-polarization antenna equipped with an isolation providing device for improving isolation between polarizations.

BACKGROUND ART

For the design of an antenna that executes transmission and reception in parallel, an important item to be considered is to secure isolation between a transmission antenna device and a reception antenna device, so that a signal transmitted from the transmission antenna is prevented from being input into the reception antenna device. When a dual-polarization antenna is used, which enables a transmission signal and a reception signal to generate different polarizations, for example, polarizations that are orthogonal to one another, the isolation may be quite secured. However, a device for further improving isolation has been provided for the dual-polarization antenna.

FIG. 1 is a circuit block diagram of a dual-polarization antenna equipped with an isolation providing device according to an embodiment of the conventional art, and the configuration illustrated in FIG. 1 is almost identical to the configuration disclosed in U.S. Pat. No. 6,141,539.

Referring to FIG. 1, the conventional dual-polarization antenna equipped with an isolation providing device may include a plurality of dual-polarization antenna parts 10 including a transmission antenna device 11 and a reception antenna device 12 that is physically or electrically orthogonal to the transmission antenna device. That is, FIG. 1 illustrates an example of a (perpendicular) array antenna structure. A transmission signal is provided through a first port (P1), passes through a feeder, and is distributed to each transmission antenna device 11 of the plurality of dual-polarization antenna units 10 for provision, and a signal received through a plurality of reception antenna devices 12 may be coupled and output to the second port (P2).

In this structure, a part of a transmission signal provided to the first port (P1) is distributed to a first coupler 21, and is provided to the second coupler 22 through a conductor 24, and the second coupler 22 couples a signal provided through the conductor 24 with a signal output to the second port (P2). In this instance, the performance of the first and second couplers 21 and 22, and the length of the conductor 24 are designed to enable the signal that is transferred to the second port (P2), through the first coupler 21, the conductor 24, and the second coupler 22 for coupling, to have an identical size and to have a difference of 180 degrees in phase, in comparison with an undesired input signal (hereinafter, referred to as an erroneously input signal) that is transmitted from the plurality of transmission antenna devices 11 and is received by the plurality of reception antennas 12.

When it is described in detail, isolation between dual polarizations is measured before installing the isolation providing device. When isolation between bands is measured, a size of an erroneously input signal and a delay of the signal are measured. Subsequently, a size of coupling of the first coupler 21 and the second coupler 22 in the isolation providing device is determined to have a value similar to a frequency-based average value of an erroneously input signal, measured in a state in which the isolation providing device is not included. In addition, the length of the conductor 24 is designed to enable the delay associated with the first coupler 21, the second coupler 22, and length of the conductor 24, to have a difference of 180 degrees in phase, from a frequency-based average value of a delay of an erroneously input signal, measured in a state in which the isolation providing device is not included.

Accordingly, the erroneously input signal that is transmitted from the first port (P1) through the plurality of transmission antenna devices 11, and is received by the plurality of reception antenna devices 12 and transferred to the second port (P2), and a signal transferred to the second port (P2) through the first coupler 21, the conductor 24, and the second coupler 22, may offset one another, and thereby, may be removed.

As a scale of an antenna becomes small, a size of a reflector of a single antenna or an array antenna also needs to be decreased. In general, when a size of a reflector is insufficient, isolation of a dual-polarization antenna becomes deteriorated. Also, a size of isolation between polarizations is not constant in a frequency range in which an antenna operates.

However, the conventional structure of FIG. 1 is effective only when the size of isolation between polarizations is constant through the entire operating frequency range for a transmission signal. Otherwise, isolation between polarizations may not be improved in the entire operating frequency range.

SUMMARY

Therefore, an aspect of the present invention is to provide a dual-polarization antenna equipped with an isolation providing device for providing an excellent isolation between polarizations.

Another aspect of the present invention is to provide a dual-polarization antenna equipped with an isolation providing device for providing a desired isolation even when a size of isolation between polarizations is not constant throughout the entire operating frequency range.

In accordance with an aspect of the present invention, there is provided a dual-polarization antenna equipped with an isolation providing device, including: at least one transmission antenna device that outputs a transmission signal provided through a feeder from a first port; at least one reception antenna that receives a reception signal and provides the same to a second port; a first coupler that distributes a part of a transmission signal provided to the first port; an equalizer that equalizes a signal distributed in the first coupler to a waveform, which is predetermined in a frequency range identical to a frequency band of the transmission signal; a second coupler that receives an output from the equalizer and couples the same with a signal output to a second port; and a conductor that forms a signal delivery path among the first coupler, the equalizer, and the second coupler, wherein a coupling performance of the first and second couplers, a length of the conductor, and a functional characteristic of the equalizer are designed to enable a signal that is transferred to the second port through the signal delivery path using the conductor for coupling, to have a substantially identical size, to have a difference of 180 degrees in phase, and to have an identical shape in an entire operating frequency band, in comparison with a signal that is output from the at least one transmission antenna device and is erroneously input to the at least one reception antenna device.

As described above, a dual-polarization antenna equipped with an isolation providing device according to the present invention provides an excellent isolation, so that a desired isolation is provided even when a size of isolation between polarizations is not constant throughout the entire operating frequency range.

DETAILED DESCRIPTION

Figure 1:
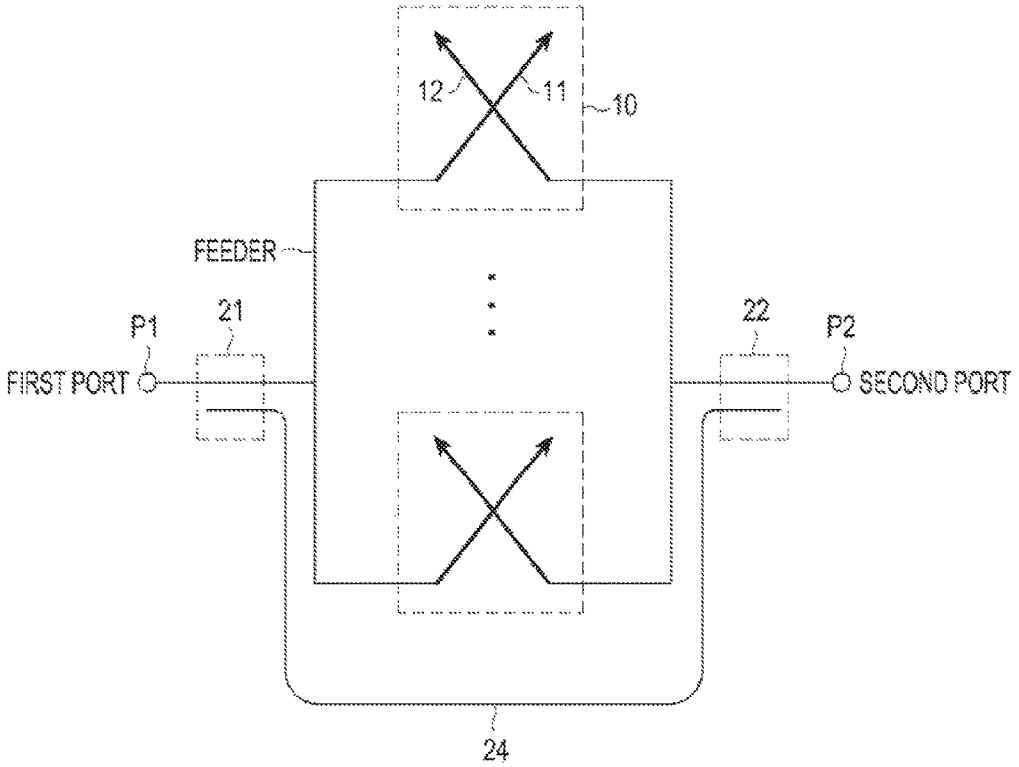
FIG.1 (RELATED ART)
FIG. 1 is a circuit block diagram of a dual-polarization antenna equipped with an isolation providing device according to an embodiment of the conventional art.

Hereinafter, exemplary embodiments of the present invention will be described with reference to the accompanying drawings. In the following description, the same elements will be designated by the same reference numerals in the drawings.

Figure 2:
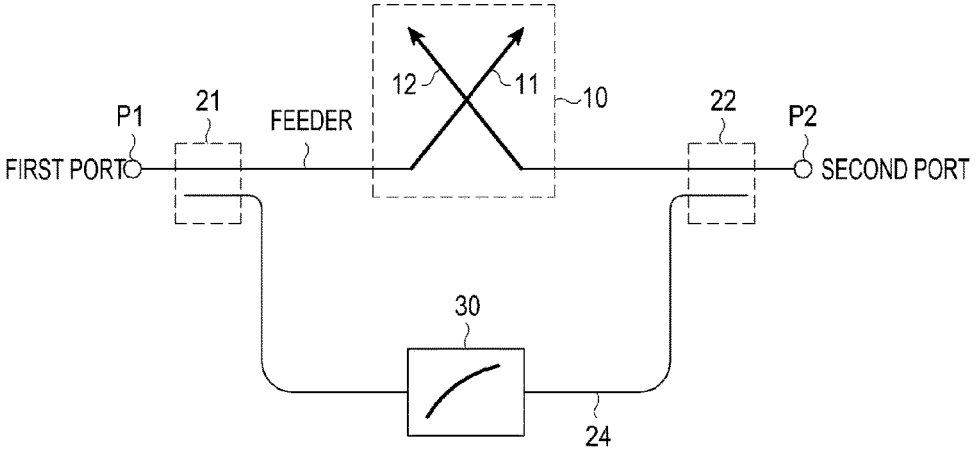
FIG. 2 is a circuit block diagram of a dual-polarization antenna equipped with an isolation providing device according to an embodiment of the present invention.

FIG. 2 is a circuit block diagram of a dual-polarization antenna equipped with an isolation providing device according to an embodiment of the present invention. Referring to FIG. 2, the dual-polarization antenna equipped with an isolation providing device according to an embodiment of the present invention basically includes the dual-polarization antenna part 10, including the transmission antenna device 11 that outputs a transmission signal that is provided from a first port (P1) through a feeder; and the reception antenna device 12 that is installed to be physically or electrically orthogonal to the transmission antenna device 11, receives a reception signal, and provides the same to a second port (P2).

An isolation providing device according to the present invention is included in the dual-polarization antenna having the above structure. The isolation providing device according to the present invention includes a first coupler 21 that distributes a part of the transmission signal provided to the first port (P1); an equalizer 30 that equalizes the signal distributed in the first coupler 21 to a shape of a predetermined waveform in a frequency range identical to the operating frequency band of the transmission signal; a second coupler 22 that receives an output of the equalizer 30 and couples the same with a signal output to the second port (P2); and the conductor 24 that forms a signal delivery path among the first coupler 21, the equalizer 30, and the second coupler 22.

The first and the second couplers 21 and 22 may employ a structure of contact-type power distributer/coupler, which is general, or a structure of contactless power distributer/coupler. In addition, the conductor 24 may be configured as a coaxial line, which is general, a strip line, a micro-strip line, or the like.

In this instance, the coupling performance of the first and second couplers 21 and 22, the functional characteristics of the equalizer 30, and the length of the conductor 24 are designed to enable the signal that is transferred to the second port (P2) through the first coupler 21, the equalizer 30, and the second coupler 22 using the conductor 24 for coupling, to have a substantially identical size, to have a difference of 180 degrees in phase, and to have an identical shape in the entire operating frequency band of a transmission signal, as described below, in comparison with an erroneously input signal that is transmitted from the transmission antenna device 11 and is undesirably received by the reception antenna device 12.

When it is described in detail, isolation between dual polarizations is measured before the isolation providing device according to the present invention is installed. When a size of an erroneously input signal and a delay of the signal are measured, isolation between bands is measured. In addition, according to the feature of the present invention, isolation in the entire operating frequency band of a transmission signal is measured. Subsequently, a size of coupling of the first coupler 21 and the second coupler 22 in the isolation providing device is determined to have a value similar to a frequency-based average value of an erroneously input signal, measured in a state in which the isolation providing device is not installed. In addition, the length of the conductor 24 is designed to enable the delay associated with the first coupler 21, the second coupler 22, and length of the conductor 24, to have a difference of 180 degrees in phase, from a frequency-based average value of a delay of an erroneously input signal, measured in a state in which the isolation providing device is not included.

In particular, in this instance, according to the feature of the present invention, the equalizer 30 is designed to execute signal processing so as to enable a waveform of the signal provided from the first coupler 21 to correspond to a waveform of an erroneously input signal, actually measured in the entire transmission frequency band.

Figure 4:
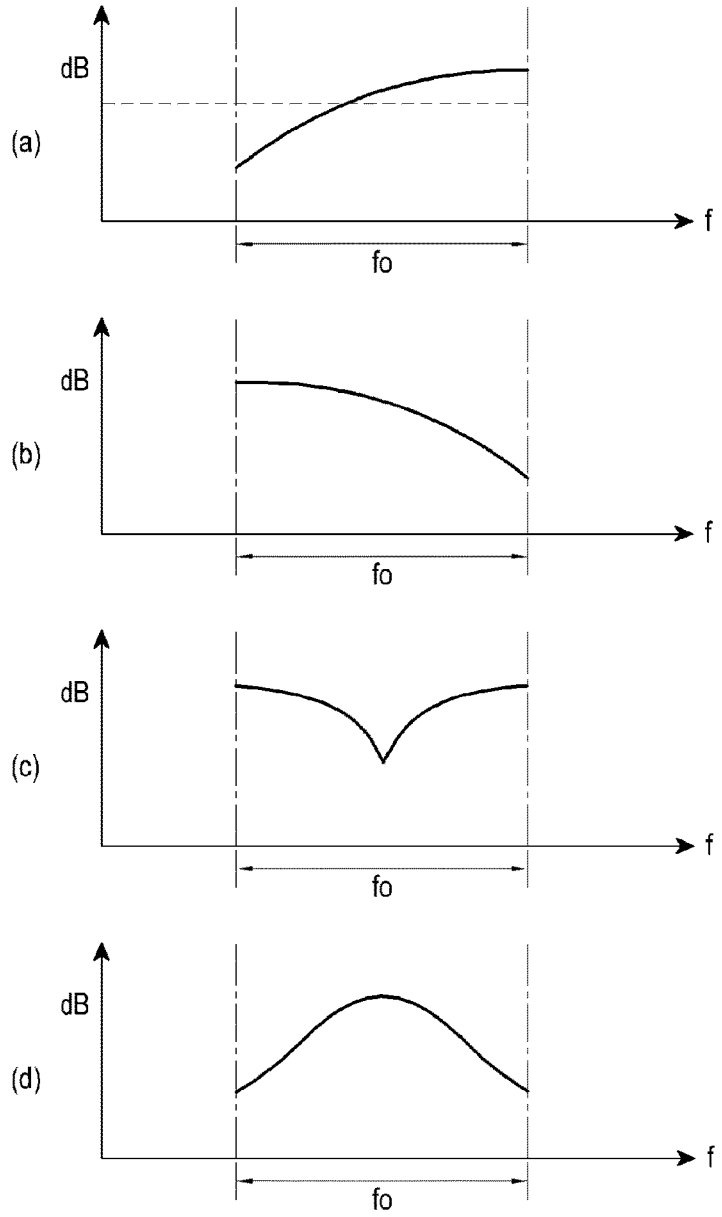
FIG. 4 is a graph illustrating an example of a functional characteristic of an equalizer of FIG. 2 or FIG. 3.

Referring to FIG. 4, particularly, in most cases, a size of an erroneously input signal, measured in the dual-polarization antenna part 10 is not identical in the entire operating frequency range (fo). For example, as illustrated by a solid line in FIG. 4A, a size of a signal is small in a relatively low frequency band in the entire operating frequency range (fo), and a size of a signal is large in a relatively high frequency band in the entire operating frequency range (fo). A signal that is separated from the first coupler 21 and is transferred through the conductor 24 is, for example, as illustrated by a break line in FIG. 4A, has a constant size in the entire operating frequency range (fo). In this instance, when an average size of a signal is merely considered like the conventional art, an erroneously input signal is not completely offset even through the signal has a difference of 180 degrees in phase. Accordingly, the present invention equalizes, for example, to a waveform illustrated by the solid line in FIG. 4A, the signal that is separated from the first coupler 21 and is transferred through the conductor 24, using the equalizer 30.

The equalizer 30 may be embodied using a filter structure, and may be embodied as a PCB (Printed Circuit Board) type which is a relatively small and simple type. In this instance, for an erroneously input signal as illustrated in FIG. 4A, the equalizer 30 may be embodied as a HPF (High Pass Filter)

structure, and for the case of FIGS. 4B through 4D, the equalizer 30 may be embodied as an LPF (Low Pass Filter) structure, a BSF (Band Stop Filter) structure, and a BPF (Band Pass Filter) structure, respectively.

Through the above described configuration and functions, an erroneously input signal that is transmitted from the first port (P1) through the transmission antenna device 11, and is received by the reception antenna device 12 and transferred to the second port (P2) may have the identical size and shape, and have a difference of 180 degrees in phase, in comparison with a signal that is transferred to the second port P2 through the first coupler 21, the equalizer 30, and the second coupler 33 using the conductor 24, and thus, may be completely offset and removed.

In comparison with the conventional art as illustrated in FIG. 1, the conventional art merely secures improvement of isolation between polarizations only when the size of isolation between polarizations of the dual-polarization antenna is constant. However, in a real environment for utilization, isolation between polarizations in the operating frequency range is not constant. The present invention may effectively improve isolation between polarizations even when the isolation between polarizations of the dual-polarization antenna is not constant in the operating frequency range.

Figure 3:
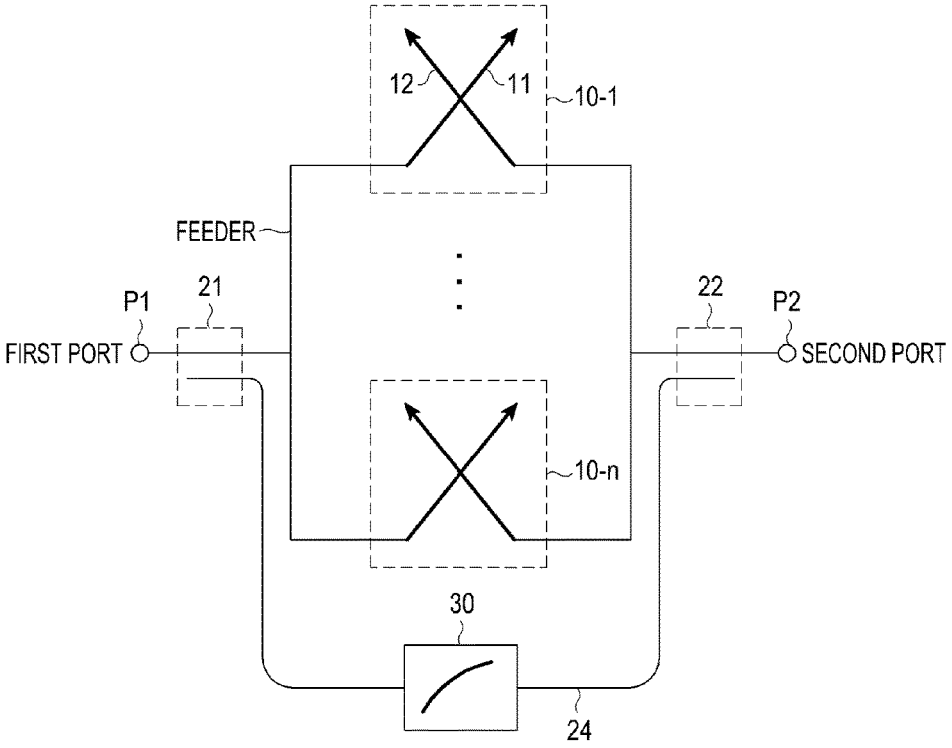
FIG. 3 is a circuit block diagram of a dual-polarization antenna equipped with an isolation providing device according to another embodiment of the present invention.

FIG. 3 is a circuit block diagram of a dual-polarization antenna equipped with an isolation providing device according to another embodiment of the present invention. Referring to FIG. 3, the configuration according to the other embodiment of the present invention has a only difference in that the configuration has a (perpendicular) array antenna including a plurality of dual-polarization antenna parts (10-1, . . . , **10-*n*), in comparison with the configuration of FIG. 2. In this instance, a transmission signal is provided through a first port (P1), passes through a feeder, and is distributed to each transmission antenna device 11 of the plurality of dual-polarization antenna parts (10-1, . . . , and 10-*n*) for provision, and a signal received by the plurality of reception antenna devices 12 is coupled and output to the second port (P2**).

In this configuration, the coupling performance of the first and second couplers 21 and 22, the functional characteristics of the equalizer 30, and the length of the conductor 24 are designed to enable the signal that is transferred to the second port (P2) through the first coupler 21, the equalizer 30, and the second coupler 22 using the conductor 24 for coupling, to have a substantially identical size, to have a difference of 180 degrees in phase, and to have an identical shape in the entire operating frequency band, in comparison with an erroneously input signal that is transmitted from the plurality of transmission antenna devices 11 and is undesirably received by the plurality of reception antenna devices 12.

The dual-polarization antenna equipped with an isolation providing device according to an embodiment of the present invention may be configured and operated as described above. Although the descriptions of the present invention exemplify detailed embodiments, various modifications may be implemented without departing from the scope of the present invention.

For example, although FIGS. 1 through 3 illustrate that the transmission antenna device 11 and the reception antenna device 12 are physically orthogonal to one another, they may be in an electrically orthogonal structure. Also, a physical installed structure of the transmission and reception antenna devices is in various shapes, such as, an X shape, a quadrangular shape, or the like. The configuration of the transmission antenna device 11 and the reception antenna device 12 may employ one of the various existing structures of the dual-polarization antenna.

In addition, although it is described that the present invention is applied to an orthogonal dual-polarization antenna, the present invention may be applied to an antenna in a structure having any other linear polarization or a circular polarization, or may be applied to a multi-polarization antenna.

The invention claimed is:

1. A dual-polarization antenna equipped with an isolation providing device, the dual-polarization antenna comprising:

at least one transmission antenna device that outputs a transmission signal provided through a feeder from a first port;

at least one reception antenna device that receives a reception signal and provides the reception signal to a second port;

a first coupler that distributes a part of the transmission signal provided to the first port;

an equalizer having a first terminal and a second terminal, wherein the equalizer includes a preset frequency response and is configured to modify a waveform of a signal distributed in the first coupler to correspond to a shape of a predetermined waveform within a frequency band of the transmission signal;

a second coupler that receives an output from the equalizer and couples the output with a signal output to the second port;

a first conductor having a first end that is coupled to the first coupler and a second end that is connected to the first terminal of the equalizer; and a second conductor having a first end that is connected to the second terminal of the equalizer and a second end that is coupled to the second coupler, wherein a coupling performance of the first and second couplers, the preset frequency response of the equalizer, and a length of the first and second conductors are designed to modify the waveform of the signal distributed in the first coupler into a waveform that has a substantially identical magnitude within the frequency band of the transmission signal and a 180 degrees phase shift, in comparison with a signal that is output from the at least one transmission antenna device and is erroneously input to the at least one reception antenna device.

2. The dual-polarization antenna as claimed in claim 1, wherein the first coupler and the second coupler have a structure of a contact-type or contactless power distributer/coupler.

3. The dual-polarization antenna as claimed in claim 1, wherein the conductor is configured as one of a coaxial line, a strip line, and a micro-strip line.

4. A method for using an isolation device to isolate a signal of a dual-polarization antenna comprising:

outputting, by a transmission antenna device, a transmission signal provided through a feeder from a first port;

receiving, by a reception antenna device, a reception signal;

transmitting, by the reception antenna device, the reception signal to a second port;

distributing, by a first coupler, a part of a transmission signal provided to the first port;

modifying, by an equalizer, a waveform of a signal distributed in the first coupler to correspond to a shape of a predetermined waveform within a frequency band of the transmission signal;

receiving, by a second coupler, an output from the equalizer;

coupling, by the second coupler, the output from the equalizer with a signal output to the second port; and transmitting a signal, by a conductor having a signal delivery path among the first coupler and the second coupler, with the equalizer disposed between the first coupler and the second coupler in the signal delivery path, wherein the signal that is transmitted to the second port through the signal delivery path has a substantially identical magnitude within the frequency band of the transmission signal and a 180 degrees phase shift, in comparison with a signal that is output from the at least one transmission antenna device and is erroneously input to the at least one reception antenna device.

5. The dual-polarization antenna as claimed in claim 1, wherein the equalizer includes a filter.

6. The dual-polarization antenna as claimed in claim 1, wherein the equalizer is configured as one of a High Pass Filter (HPF) structure, a Low Pass Filter (LPF) structure, a Band Stop Filter (BSF) structure, or a Band Pass Filter (BPF) structure.

* * * * *